US008960497B2

(12) United States Patent
Lefeber

(10) Patent No.: US 8,960,497 B2
(45) Date of Patent: Feb. 24, 2015

(54) MULTI-SHELL DISPENSER FOR SHOTGUN

(71) Applicant: Safariland, LLC, Jacksonville, FL (US)

(72) Inventor: Anthony Lefeber, Canyon Lake, CA (US)

(73) Assignee: Safariland, LLC, Jacksonville, FL (US)

( * ) Notice: Subject to any disclaimer, the term of this patent is extended or adjusted under 35 U.S.C. 154(b) by 14 days.

(21) Appl. No.: 13/705,679

(22) Filed: Dec. 5, 2012

(65) Prior Publication Data

US 2014/0001201 A1 Jan. 2, 2014

Related U.S. Application Data

(60) Provisional application No. 61/567,997, filed on Dec. 7, 2011.

(51) Int. Cl.
*F42B 39/26* (2006.01)

(52) U.S. Cl.
CPC ..... *F42B 39/26* (2013.01)
USPC ..... 221/309; 221/307; 221/197; 42/87; 42/88

(58) Field of Classification Search
CPC ..... F42B 39/002; F42B 39/26
USPC ..... 221/307, 309, 197; 42/87, 88

See application file for complete search history.

(56) References Cited

U.S. PATENT DOCUMENTS

| | | | | |
|---|---|---|---|---|
| 278,980 | A * | 6/1883 | Livermore et al. | 42/88 |
| 2,122,003 | A * | 6/1938 | Cooper | 221/185 |
| 3,219,244 | A * | 11/1965 | Blask | 221/310 |
| 3,669,249 | A * | 6/1972 | Foster | 206/3 |
| 4,583,659 | A * | 4/1986 | Carter | 221/279 |
| 4,653,666 | A * | 3/1987 | Mertens | 221/45 |
| 6,817,135 | B1 * | 11/2004 | Jackson | 42/87 |
| 2005/0189372 | A1 * | 9/2005 | Fenton | 221/231 |
| 2011/0024440 | A1 * | 2/2011 | Kaiser et al. | 221/1 |

OTHER PUBLICATIONS

Safariland Model 082 Shotgun Shell Carrier.*
Prior Art California Competition Works Tactical Stripper.
Prior Art OPSGEAR Tactical Stripper.
Prior Art Safariland Model 082 Shotgun Shell Carrier.

* cited by examiner

*Primary Examiner* — Patrick Mackey
(74) *Attorney, Agent, or Firm* — Kane Kessler, P.C.; Paul E. Szabo

(57) ABSTRACT

A dispenser holds a number of shotgun shells, which a shooter can retrieve quickly one or two at a time, to reload the shotgun. The shells that remain in the dispenser do not rattle around loosely but rather are held in position in the dispenser, from which position they can easily be extracted.

9 Claims, 4 Drawing Sheets

MULTI-SHELL DISPENSER FOR SHOTGUN

RELATED APPLICATIONS

This application is a nonprovisional of U.S. Provisional Application No. 61/567,997, filed Dec. 7, 2011, by the same inventor, the entire disclosure of which is hereby incorporated by reference.

BACKGROUND OF THE INVENTION

This application relates to a dispenser for ammunition. In particular, this application relates to a dispenser that holds a number of shotgun shells, which a shooter can retrieve quickly one or two at a time, to reload the shotgun. The shells that remain in the dispenser do not rattle around loosely but rather are held in position in the dispenser, from which position they can easily be extracted. The invention is applicable to other types of ammunition, also.

DETAILED DESCRIPTION

This application relates to a dispenser for ammunition. In particular, this application relates to a dispenser that holds a number of shotgun shells, which a shooter can retrieve quickly one or two at a time, to reload the shotgun. The shells that remain in the dispenser do not rattle around loosely but rather are held in position in the dispenser, from which position they can easily be extracted. The invention is applicable to other types of ammunition, also.

Figure 4:
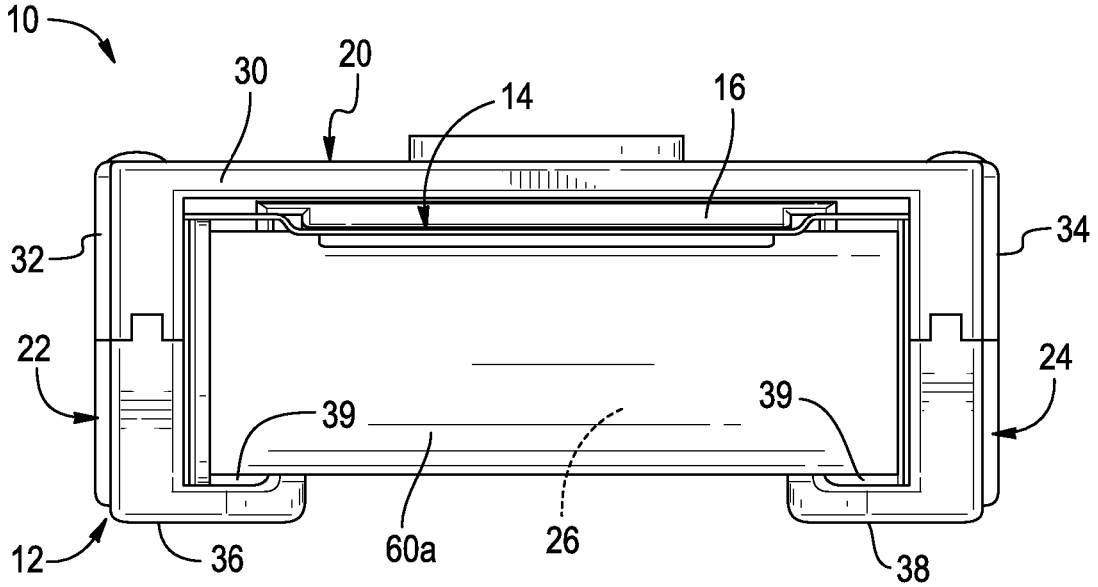
FIG. 4 is a transverse sectional view of the dispenser of FIG. 1.
Figure 7:
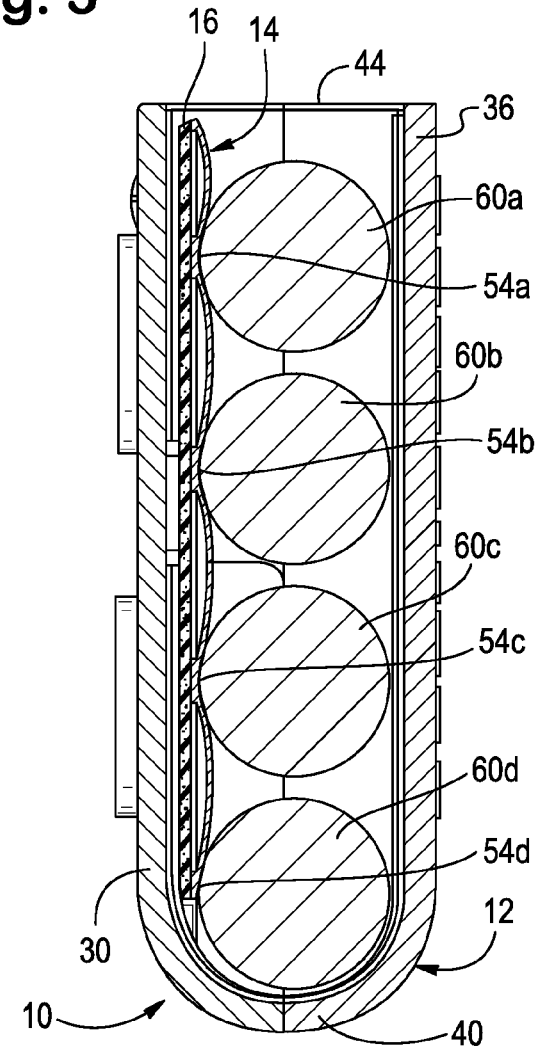
FIG. 7 is a longitudinal sectional view of the dispenser of FIG. 1 with four shotgun shells in it, taken through the shells.

The dispenser includes a container 12 (FIG. 1) that supports a retainer 14 and an associated spring 16 (FIGS. 4 and 7). In the illustrated embodiment, the container 12 is made from three separate pieces of plastic held together by screws. The three pieces (FIG. 4) include a back piece 20 and two side pieces 22 and 24. Together, the three pieces 20-24 form the container 12 and define, in the container, a shell chamber 26. Alternatively, the container can be one piece.

Figure 1:
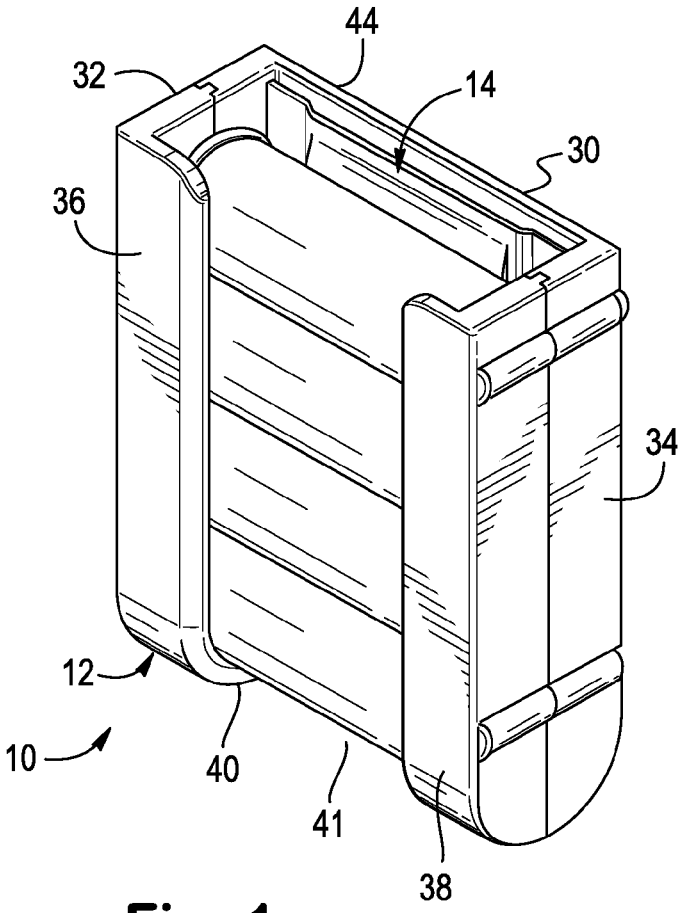
FIG. 1 is a front perspective view of a dispenser that is a first embodiment of the invention, shown with four shotgun shells in it.
Figure 2:
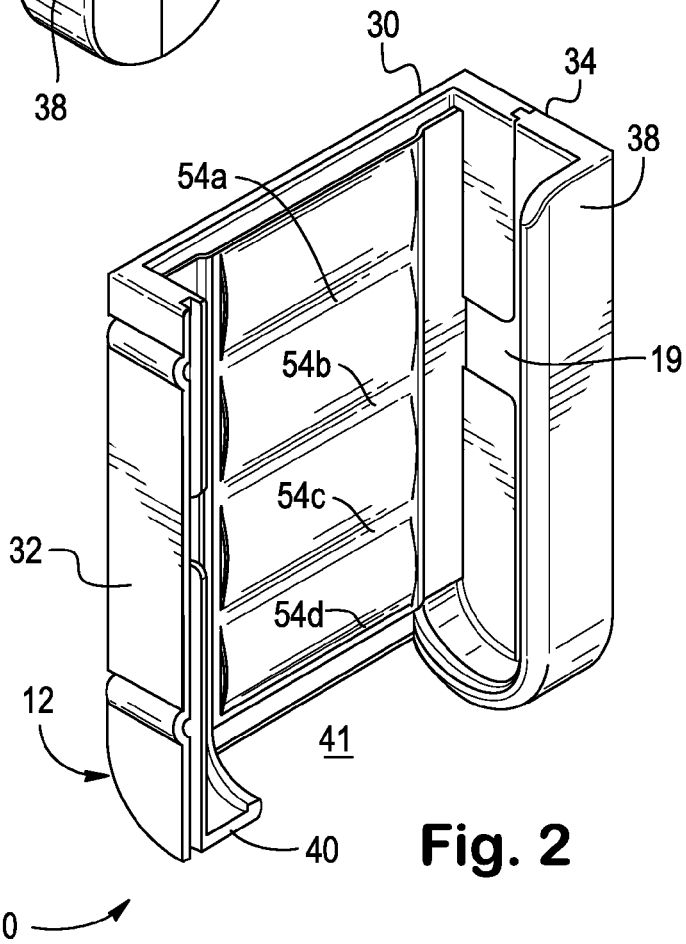
FIG. 2 is a front perspective view, from a different angle, of the dispenser of FIG. 1, empty.
Figure 3:
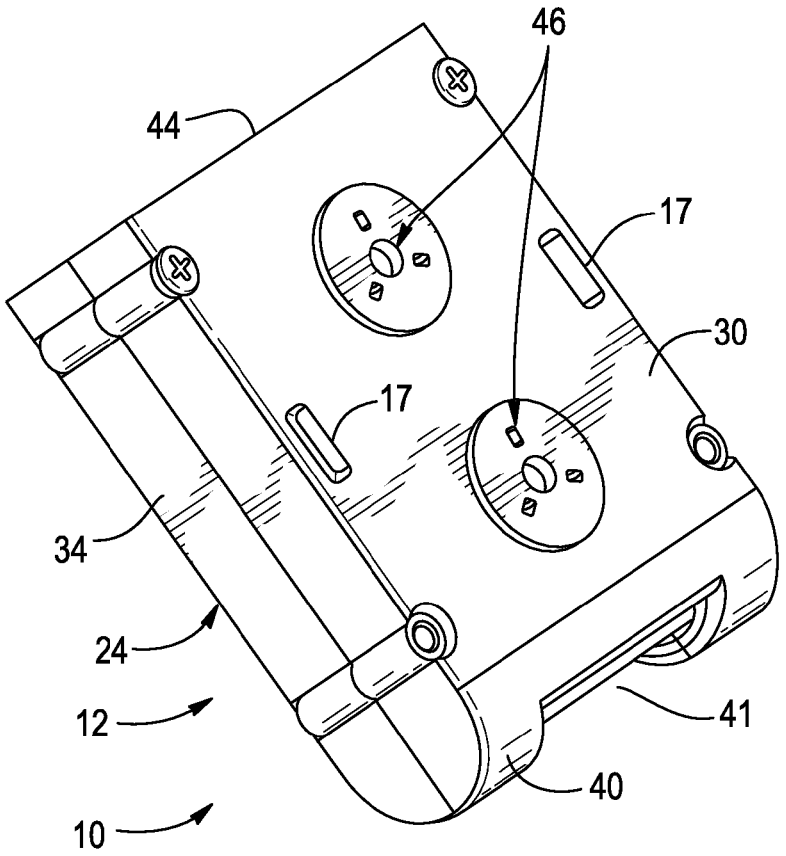
FIG. 3 is back perspective view of the dispenser of FIG. 1.

The container 12 as thus formed includes a back wall 30, two side walls 32 and 34, two front walls 36 and 38, and a curved lower end wall 40 (FIGS. 1-3). The lower end wall 40 has an opening 41 that is shorter in width than the length of the shells to be dispensed. The opposite upper end 44 (FIG. 1) of the container 12 is open, and the side walls 32 and 34 are there spaced apart by a distance sufficient to enable removal of the shells as desired.

The dispenser 10 includes features, preferably on the outside of the back wall 30, to enable attachment of a clip or other device (not shown) to help support the dispenser on, for example, an article of clothing such as a belt or a vest. For example, two locations 46 (FIG. 3) may be provided for receiving tee nuts (not shown) for this purpose.

Disposed in the shell chamber 16 are the retainer 14 and the spring 16. The retainer 14 (FIGS. 4, 5 and 7) is a stiff resilient member that may be made from metal or plastic. The retainer 14 extends for substantially the entire length of the shell chamber 26. The retainer 14 is secured in the container 12 in a position overlying but spaced apart from the back wall 30 of the container. The retainer 14 has tabs 15 (FIG. 5) on its long edges. The tabs 15 fit into slots 17 (FIG. 3) on the back wall 30 of the container. The container side pieces 22 and 24 have extensions 19 (FIG. 2) to help hold the retainer 14 in a position in which the spring 16 can apply even force.

The container front walls 36 and 38 have recessed steps 39 (FIG. 4) for receiving the radially enlarged end flanges of the shells. This allows the shells to sit flat against the retainer 14. Because there are steps 39 on both front walls 36 and 38, the shells can be loaded in either orientation within the dispenser 10, and the dispenser can thus be used by either a right handed user or a left handed user.

The retainer 14 (FIG. 5) has a wave-like configuration including four crests 50*a*-50*d* separated by three troughs 52*a*-52*c* that are recessed below the crests. In addition, the longitudinal ends of the retainer 14 are also recessed below the level of the troughs, to allow the spring pressure to be even across the shells. Thus, when the retainer 14 is in the container 12, four shell positions 54*a*-54*d* are defined by the crests and troughs of the retainer 14, at the location of the troughs. When the retainer 14 is in the container 12, the first shell position 54*a* is located near the open end 44 of the container 12; the second, third and fourth shell positions 54*b*-54*d* are spaced along the length of the container 12.

The spring 16 (FIGS. 4 and 7) is disposed between the back wall 30 of the container 12 and the retainer 14. The spring 16 extends generally parallel to and between both the container wall 30 and the retainer 14. The spring 16 biases the retainer 14 in a direction away from the back wall 30 of the container 12. In the illustrated embodiment, the spring 16 is a flat piece of resilient foam that underlies substantially all the retainer 14, between the retainer and the back wall 30 of the container 12. In other embodiments, the spring 16 could be made differently, or could be formed with or as part of the retainer 14. One example is discussed below with reference to FIGS. 8 and 9.

When the shells are loaded in the dispenser 12 (FIG. 7), they are in the shell positions 54*a*-54*d* defined by the retainer 14. A first shell 60*a* is located in the first shell position 54*a*, adjacent the open end 44 of the container 12. Second, third and fourth shells 60*b*, 60*c* and 60*d* are then spaced along the length of the container 12 toward the closed end of the container. The fourth shell 60*d* is located in the fourth shell position 54*d* at the closed end of the container 12, adjacent the lower end wall 40.

The dimensions and configuration of the container 12, retainer 14, and spring 16 are selected to cause the shells 60*a*-60*d* to be releasably retained in the dispenser 10, as shown in FIGS. 1 and 7, with a minimum of (or no) movement or rattling noise First, the spring 16 presses the retainer 14 laterally against the shells 60*a*-60*d*, which are thereby pressed against the front walls 36 and 38 of the container 12.

Second, the crests and troughs of the retainer 14 retain the shells 60*a*-60*d* longitudinally in the container 12. The shells 60*a*-60*d* are located in the shell positions 54*a*-54*d*, between the crests 50*a*-50*d*. The crests 50*a*-50*d* prevent the shells 60*a*-60*d* from moving in the shell chamber 26 in a direction along the length of the container 12. The first crest 50*a* of the retainer 14 prevents the first shell 60*a* from exiting the dispenser through the open end 44.

Figure 5:
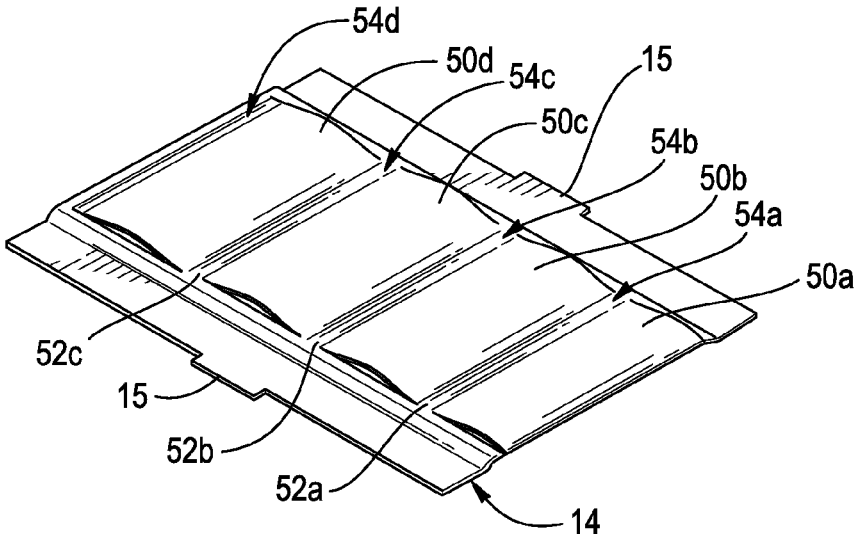
FIG. 5 is a perspective view of a retainer that forms part of the dispenser of FIG. 1.
Figure 6:
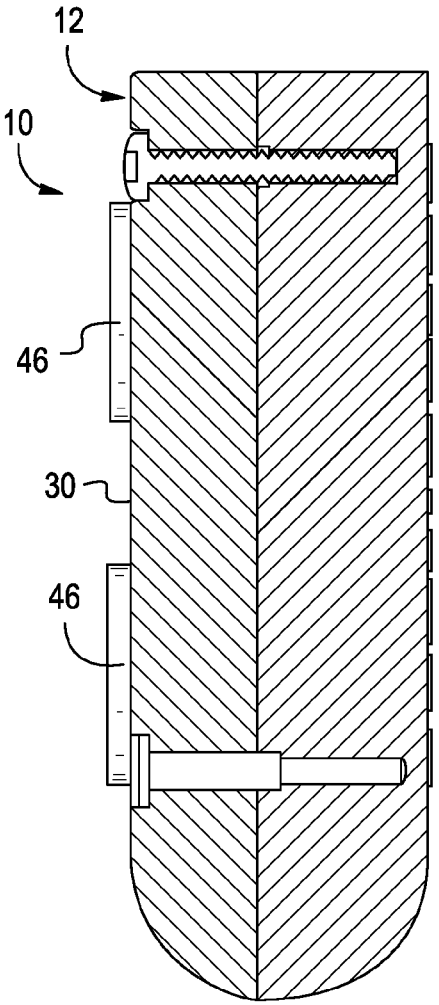
FIG. 6 is a longitudinal sectional view of the dispenser of FIG. 1, taken through the dispenser walls.

When the user desires to remove one or more shells 60, the user grasps the desired number of shells and pulls them toward the open end 44 of the dispenser 10 (upward as viewed in FIG. 5). The force applied by the user is sufficient to overcome the resistance to movement provided by the retainer 14 and the spring 16. As the user pulls out the shells 60, they press against the associated crests on the retainer 14, pushing the retainer toward the container back wall 30 (to the left as viewed in FIG. 5), against the bias of the spring 16. The spring 16 is compressed, allowing the end portion of the retainer 14 that includes the first crest 50*a* to move away from the front walls 36 and 38 sufficiently to enable removal of the shells 60 from the dispenser 10.

Thereafter, the spring 16 pushes the retainer 14 back into its original position, holding the remaining shells securely in position in the dispenser 10. For example, if only the first shell 60*a* is removed, then after it passes over the first crest 50*a* the spring 16 pushes the retainer 14 back into its original position, holding the other three shells 60*b*-60*d* securely in position in the dispenser 10.

The force of the spring 16 and the freedom of movement of the retainer 14 retain the remaining shells in position in the dispenser 10, with a minimum of (or no) movement and rattling noise, until the user grasps the next shell. Whenever one shell is removed, each of the other shells is in the same position in the dispenser 10 as it was before, making it easy for the user, without looking, to reach for and grasp the next shell or shells.

Figure 8:
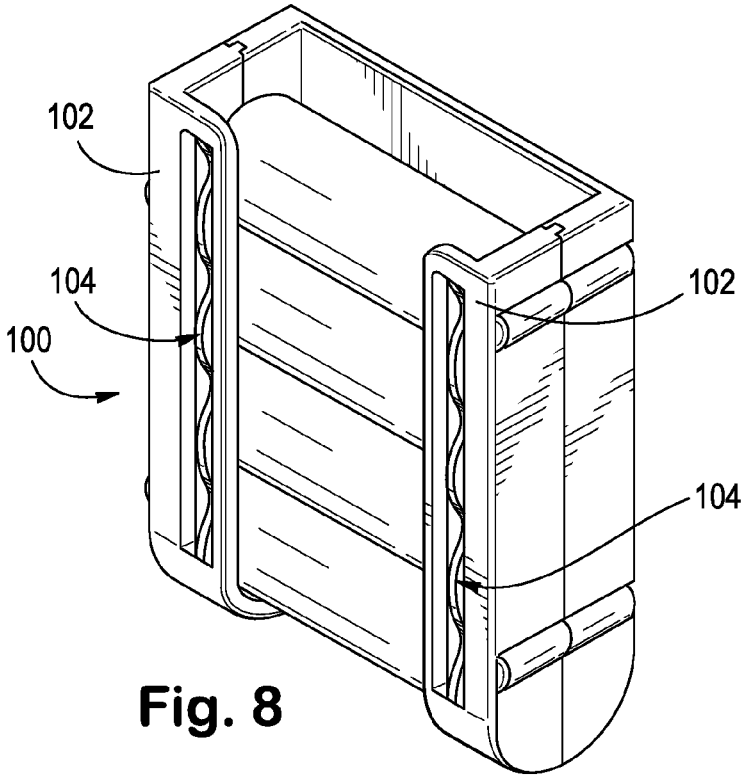
FIG. 8 is a front perspective view of a dispenser that is a second embodiment of the invention, shown with four shotgun shells in it.
Figure 9:
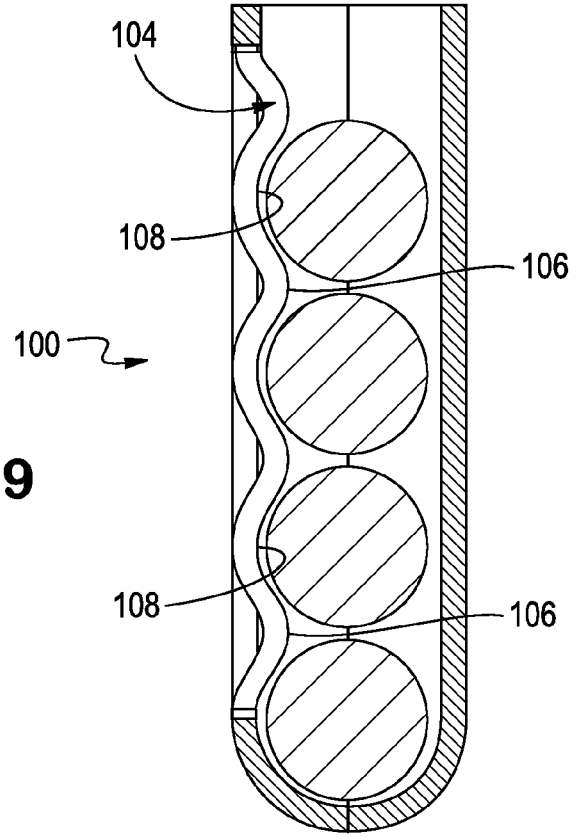
FIG. 9 is a longitudinal sectional view of the dispenser that is a second embodiment of the invention of FIG. 8 with four shotgun shells in it, taken through the shells.

FIGS. 8 and 9 illustrate a dispenser 100 that is another embodiment of the invention. In the dispenser 100, the functions of the spring and retainer are performed by portions of the container itself. Specifically, the dispenser 100 includes left and right front walls 102 each of which includes a spring 104 having a wave-like configuration including crests 106 and troughs 108. The shells fit into the troughs 108 in the springs 104. The springs 104 are resilient and thus maintain the shells in position in the dispenser. When the user applies force to remove one or more of the shells, the springs 104 flex, allowing the shells to be pulled longitudinally along the walls 102 and out of the dispenser 100.

The invention claimed is:

1. A dispenser for holding a plurality of shotgun shells, comprising:

a container dimensioned to contain a plurality of shells adjacent each other, the container having an opening at one end through which the shells can be inserted into and removed from the container;

a retainer for holding the shells in the container, the retainer defining a plurality of shell positions in the container; and a spring acting between a first container wall and the retainer to cause the retainer to urge the shells away from the first container wall thereby to releasably hold the shells in the shell positions in the container;

the retainer being movable toward the first container wall against the force of the spring to enable a selected shell to be moved out of its shell position in a direction toward the opening thereby to enable removal of the shell from the container;

wherein the retainer has a wave configuration including crests and troughs defining the plurality of shell positions in the container.

2. A dispenser as set forth in claim 1 wherein the spring has an amount of spring force that is selected to hold the shells in the shell positions in the container without rattling but to be easily removable against the spring force.

3. A dispenser as set forth in claim 1 wherein the spring is a flat piece of resilient foam plastic.

4. A dispenser for holding a plurality of shotgun shells, comprising:

a container dimensioned to contain a plurality of shells adjacent each other, the container having an opening at one end through which the shells can be inserted into and removed from the container;

the container including a retainer for holding the shells in the container, the retainer having a wave configuration with crests and troughs defining a plurality of shell positions in the container; and the container including a spring associated with the retainer and acting with a spring force to cause the retainer to releasably hold the shells in the shell positions in the container;

the retainer being movable toward the container wall against the force of the spring to enable a shell to be moved out of its shell position in a direction toward the opening thereby to enable removal of the shell from the container.

5. A dispenser as set forth in claim 4 wherein the amount of spring force is selected to hold the shells in the container without rattling but being easily removable against the spring force.

6. A dispenser as set forth in claim 4 wherein the container and the retainer and the spring are formed as one piece from plastic.

7. A dispenser as set forth in claim 6 wherein the retainer includes first and second retainer portions that engage opposite ends of the shells when the shells are held in the container.

8. A dispenser for holding a plurality of shotgun shells, comprising:

a container dimensioned to contain a plurality of shells adjacent each other, the container having an opening at one end through which the shells can be inserted into and removed from the container;

a retainer for holding the shells in the container, the retainer defining a plurality of shell positions in the container; and a spring acting between a first container wall and the retainer to cause the retainer to urge the shells away from the first container wall thereby to releasably hold the shells in the shell positions in the container;

the retainer being movable toward the first container wall against the force of the spring to enable a selected shell to be moved out of its shell position in a direction toward the opening thereby to enable removal of the shell from the container;

wherein the retainer has a plate configuration and is a stiff resilient member having a wave-like configuration defining a plurality of crests and troughs, the shell positions being located at the troughs.

9. A dispenser as set forth in claim 8 wherein the spring is a flat piece of resilient foam plastic underlying the retainer at a location between the retainer and the first wall of the container, each of the container first wall and the spring and the retainer being substantially parallel to each other.

* * * * *